US010124238B2

(12) United States Patent
McCrane

(10) Patent No.: US 10,124,238 B2
(45) Date of Patent: Nov. 13, 2018

(54) OVERLAPPING PALM GROVE

(75) Inventor: David Patrick McCrane, Napa, CA (US)

(73) Assignee: Implus Footcare, LLC, Durham, NC (US)

( * ) Notice: Subject to any disclaimer, the term of this patent is extended or adjusted under 35 U.S.C. 154(b) by 1973 days.

(21) Appl. No.: 12/842,390

(22) Filed: Jul. 23, 2010

(65) Prior Publication Data

US 2012/0017350 A1 Jan. 26, 2012

(51) Int. Cl.

*A63B 71/14* (2006.01)
*A63B 21/00* (2006.01)
*A63B 21/06* (2006.01)

(52) U.S. Cl.

CPC ..... *A63B 71/141* (2013.01); *A63B 21/4019* (2015.10); *A63B 21/4035* (2015.10); *A63B 21/06* (2013.01)

(58) Field of Classification Search

CPC ..... A63B 71/141; A63B 21/4019; A63B 21/4035; A63B 21/06

USPC ..... 2/16, 20, 158, 159, 160, 161.1, 161.4, 2/161.5, 161.6, 170

See application file for complete search history.

(56) References Cited

U.S. PATENT DOCUMENTS 3,348,238 A * 10/1967 Hydock ..... 2/161.2
3,559,212 A * 2/1971 Skovron ..... 2/161.4
4,197,592 A 4/1980 Klein
4,388,733 A * 6/1983 Anstett ..... 2/16
4,400,831 A * 8/1983 Rietz ..... 2/161.1
4,675,914 A 6/1987 Mitchell
4,720,279 A 1/1988 Fritschen et al.
4,793,005 A * 12/1988 Hetzel, Jr. ..... 2/161.1
4,977,621 A 12/1990 Richard
5,004,231 A * 4/1991 Alread ..... 482/139
5,182,814 A * 2/1993 Christensen ..... 2/161.1
5,353,440 A 10/1994 Meldeau
5,435,013 A 7/1995 Davis
5,557,806 A * 9/1996 Caswell et al. ..... 2/161.1
5,634,213 A 6/1997 Grover
(Continued)

*Primary Examiner* — Danny Worrell
(74) *Attorney, Agent, or Firm* — Edward S. Wright

(57) ABSTRACT

A glove for gripping an object having an inner glove with a lower palm section of relatively non-stretchable material and an upper palm section of relatively stretchable material that overlie the palm side of the hand of person wearing the glove, a back section that overlies the back of the hand, and stalls for receiving the fingers and thumb. An outer panel overlies substantially the entire palm section and is attached to the inner glove along the upper margin of the outer panel and partially or wholly detached from the inner glove along at least one side of the outer panel. The lower margin of the outer panel is also attached to the inner glove in some embodiments, and in others it is secured to the wrist separately from the inner glove. In some disclosed embodiments, the outer panel is fabricated of elastic material that draws the hand toward a closed position for gripping the object. In others, it is fabricated of a relatively non-stretchable material that is attached at one end to the base portion of the palm section and extends beyond the finger stalls, with a distal end portion of the panel being rolled back and attached to the front sides of the stalls so that it can flatten out and extend farther up the fingers when the hand is curled about the object.

26 Claims, 4 Drawing Sheets

(56) References Cited

U.S. PATENT DOCUMENTS

| | | | | |
|---|---|---|---|---|
| 5,809,570 | A | 9/1998 | Grover | |
| 5,898,944 | A | 5/1999 | Vrany | |
| 6,154,885 | A * | 12/2000 | Kobayashi et al. | 2/161.3 |
| 6,393,615 | B1 | 5/2002 | Bedell | |
| 6,427,247 | B1 * | 8/2002 | Suk | 2/161.2 |
| 6,509,385 | B2 | 1/2003 | Sereboff | |
| 6,704,939 | B2 | 3/2004 | Faulconer | |
| 7,051,377 | B1 * | 5/2006 | Milner et al. | 2/159 |
| 7,431,657 | B2 | 10/2008 | Whitehead, II et al. | |
| 7,530,120 | B2 | 5/2009 | Morrow et al. | |
| 2003/0051285 | A1 | 3/2003 | Bower | |
| 2006/0205526 | A1 | 9/2006 | Whitehead, II et al. | |
| 2009/0275418 | A1 | 11/2009 | Whitehead, II et al. | |

* cited by examiner

Fig. 6
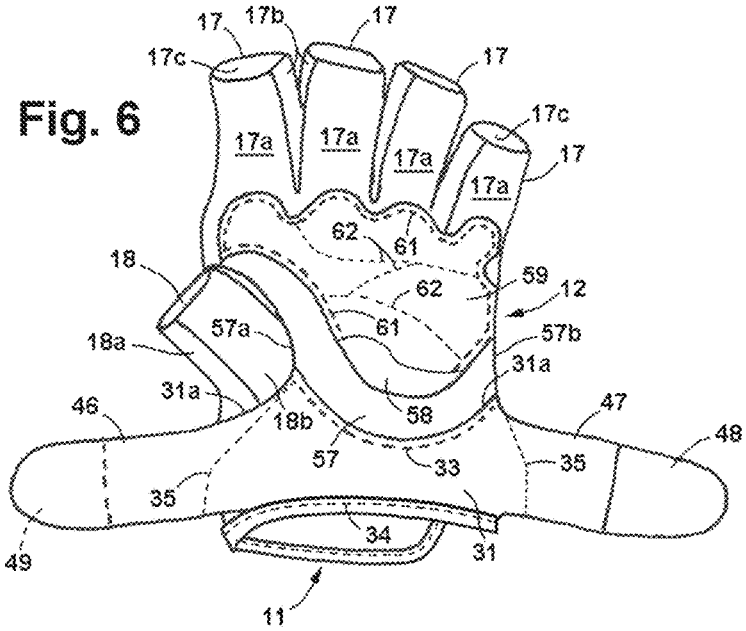
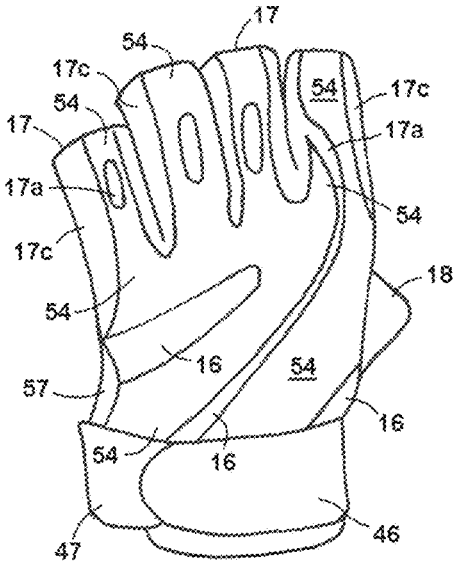
Fig. 7
Fig. 8
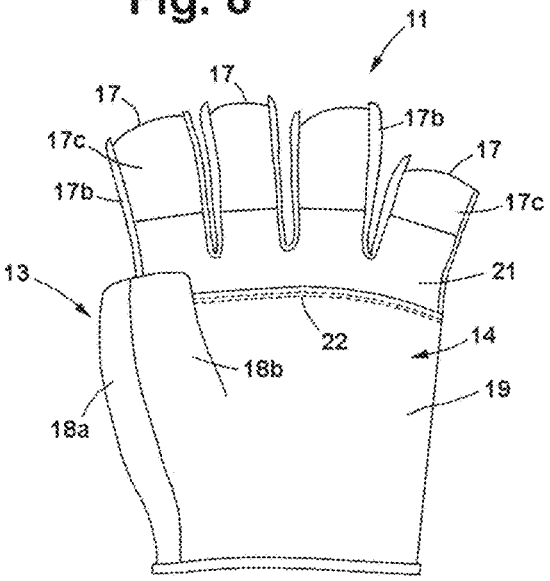

OVERLAPPING PALM GROVE

BACKGROUND OF THE INVENTION

Field of Invention

This invention pertains generally to gloves and, more particularly, to a glove for use by a person engaging in an activity such as weightlifting and other activities in which an object is gripped by the hand.

Related Art

People engaging in activities such as weightlifting where the grip on an object is important commonly use gloves to protect their hands and to get a better grip on the object. A common problem with such gloves is a bunching or gathering of the material between the hand and the object when the hand is wrapped about an object such as the bar of a barbell or dumbbell. Such bunching or gathering prevents a person from getting a firm, continuous grip on the object.

OBJECTS AND SUMMARY OF THE INVENTION

It is, in general, an object of the invention to provide a new and improved glove for use by a person engaging in an activity such as weightlifting and other activities in which an object is gripped by the hand.

Another object of the invention is to provide a glove of the above character which overcomes the limitations and disadvantages of gloves heretofore provided for such use.

These and other objects are achieved in accordance with the invention by providing an inner glove having a lower palm section of relatively non-stretchable material and an upper palm section of relatively stretchable material that overlie the palm side of the hand of person wearing the glove, a back section that overlies the back of the hand, and stalls for receiving the fingers and thumb. An outer panel overlies substantially the entire palm section and is attached to the inner glove along the upper margin of the outer panel and detached from the inner glove along at least one side of the outer panel. In some disclosed embodiments, the lower margin of the outer panel also attached to the inner glove, and in others it is secured about the wrist separately from the inner glove. In some embodiments, the outer panel is fabricated of elastic material that draws the hand toward a closed position for gripping the object. In others, it is fabricated of a relatively non-stretchable material that is attached at one end to the base portion of the palm section and extends beyond the finger stalls, with a distal end portion of the panel being rolled back and attached to the front sides of the stalls so that it can flatten out and extend farther up the fingers when the hand is curled about the object.

BRIEF DESCRIPTION OF THE DRAWINGS

FIG. 6 is a front isometric view, partly broken away, of another embodiment of a glove incorporating the invention.

FIG. 7 is rear elevational view of the embodiment of FIG. 6.

FIG. 8 is a front elevational view of the inner glove in the embodiment of FIG. 6.

DETAILED DESCRIPTION

Figure 1:
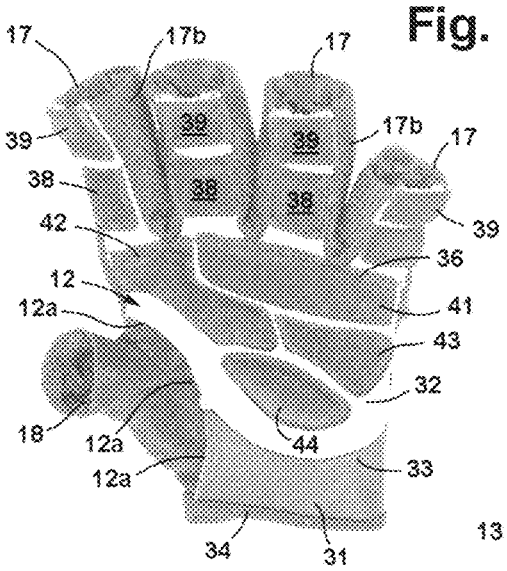
FIG. 1 is a front isometric view of one embodiment of a glove incorporating the invention.
Figure 2:
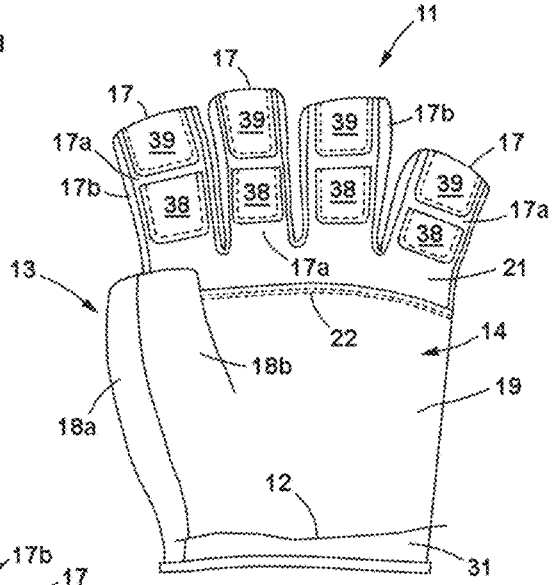
FIG. 2 is a front elevational view, partly broken away, of the embodiment of FIG. 1.
Figure 3:
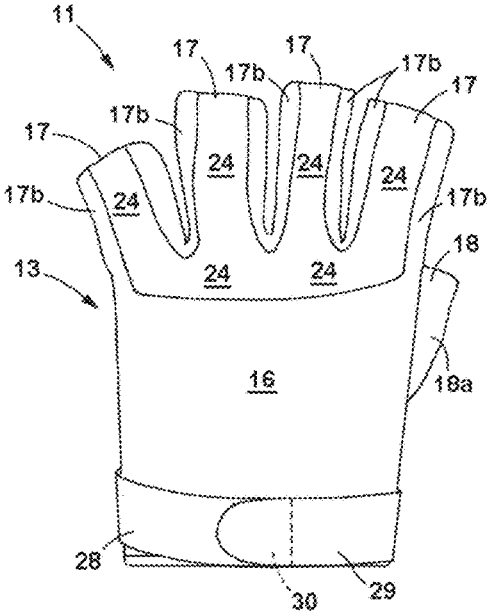
FIG. 3 is a rear elevational view of the embodiment of FIG. 1.

As illustrated in FIGS. 1-3, the glove includes an inner glove 11 and an outer panel 12 on the palm side of the inner glove.

The inner glove has a body 13 with a palm or front side 14 and a back side 16 which are shaped to conform generally to the palm and to the back of the user's hand. Finger stalls 17 extend from the upper portion of the body, and a thumb stall 18 extends from the front. The palm section has a lower section 19 fabricated of a substantially non-stretchable material such as leather and an upper section 21 fabricated of a relatively thin, flexible material such as a Lycra® fabric or other suitable material which extends to the tips of the finger stalls and forms the front walls or portions 17*a* of the finger stalls. The upper and lower palm sections are joined together by stitching 22 between the bases of the finger stalls and the transverse fold lines of the palm of a hand wearing the glove.

The sides of the finger stalls 17*b* and the back of the thumb stall 18*a* are fabricated of a stretchable material such as spandex, and the front of the thumb stall 18*b* is fabricated of the same substantially non-stretchable material as the lower portion of the palm section 19. The back 16 of the glove body 13 and the backs of finger stalls 17 are fabricated of a continuous piece of elastic or stretchable material such as Lycra® fabric, with leather sections 24 over the stretchable material on the backs of the finger stalls and the portion of the hand just below the finger stalls to minimize and control the amount of stretch to better fit the user's hand.

Leather straps 28, 29 extend around the lower back side of the glove to secure the glove to the hand and anchor the lower end of outer panel 12 to the hand and wrist. The leather straps are attached to opposite sides of the inner glove and are secured together with a Velcro® fastener 30 on the back side of the hand.

Outer panel 12 includes a non-stretchable leather section 31 at the base of the palm and a stretchable section 32 of a material such as Lycra® fabric that overlies the rest of the palm, with the two sections being joined together by stitching 33. The lower edge portion of the leather section is attached to the lower edge portion of the lower palm section 19 of inner glove 11 by stitching 34, and the upper edge portion of the stretchable section is attached to the upper palm section 21 of the inner glove by stitching 36 just below the bases of the finger stalls.

Outer panel 12 is attached to the inner body of the glove along the ring finger side of the body, but is detached from the body along the thumb side of lower palm section 19, with a free edge 12*a* of the panel extending generally along the base of thumb stall 18. Being detached in this manner the outer panel is free to move relative to the palm section of the inner glove, with minimal friction on the surface of the skin on the palm. The outer panel pre-tensions the palm section and expands and contracts as the hand is curled and uncurled, gently drawing the hand toward the curled position to facilitate gripping of the object.

Pads are provided on the fronts of the finger stalls and on the palm section of the glove to further enhance the grip on the object. Thus, pads 38 and 39 are attached to finger stalls 17 in position to overlie the lower and middle sections of the four fingers, and pads 41-44 are attached to outer panel 12 in position to overlie the fleshier areas of the palm.

In a presently preferred embodiment, the pads on the finger stalls and the upper part of the palm contain a moldable, clay-like substance that is substantially non-compressible and retains its shape without hardening. Being malleable and readily reshapable, the material fills in gaps between the fleshy parts of the fingers and palm and provides a substantially continuous gripping surface for engagement with a cylindrical object about which the hand is curled. The material is preferably one which is also cohesive and non-oozing such that it does not require a liquid-tight bladder to contain it. The two pads on the lower part of the palm contain a resilient foam material, although they can also be filled with the moldable, clay-like material instead of the foam, if desired. Such pads and their use on gloves for gripping objects are described and illustrated in greater detail in copending application Ser. No. 12/842,362, filed of even date, the disclosure of which is incorporated herein by reference.

The pads on the finger stalls and the pads on the palm section are spaced apart along lines that correspond generally to the joint lines of the fingers and palm of the person wearing the glove, with the thin, flexible material between the pads forming living hinges between the pads. The spacing between the pads is such that when the hand is curled about the object such as a bar, the thin, flexible material connecting the pads flexes, allowing adjacent portions of the pads to come together and form a substantially continuous gripping surface that matches the contour of the bar. At the same time, the moldable material fills the voids between the fleshy parts of the palm and fingers, thereby providing a firm, solid grip between the hand and the bar, with only the leather portions of the glove contacting the bar.

Figure 4:
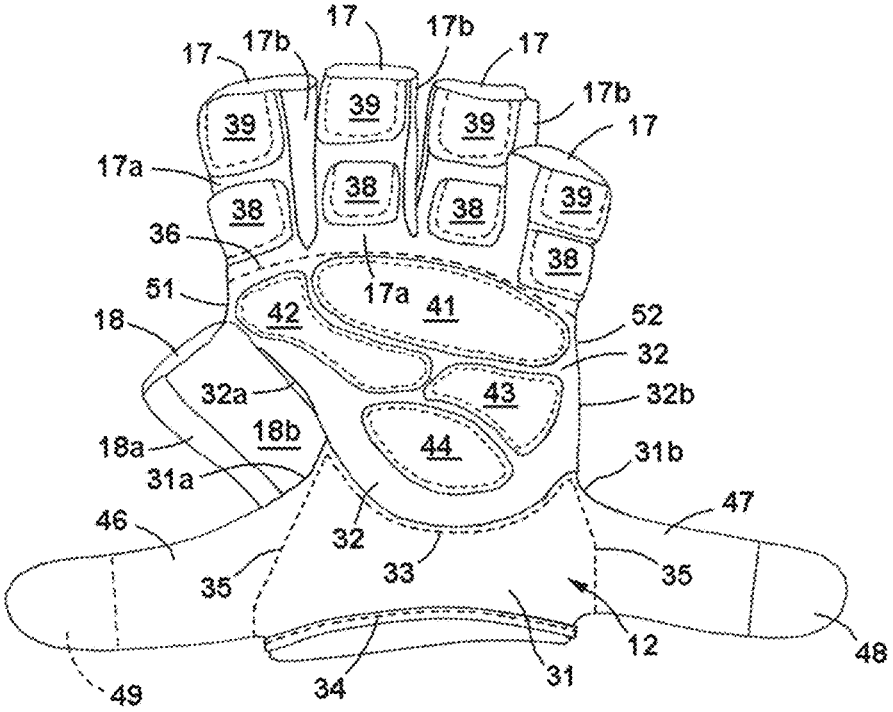
FIG. 4 is a front isometric view of another embodiment of a glove incorporating the invention.
Figure 5:
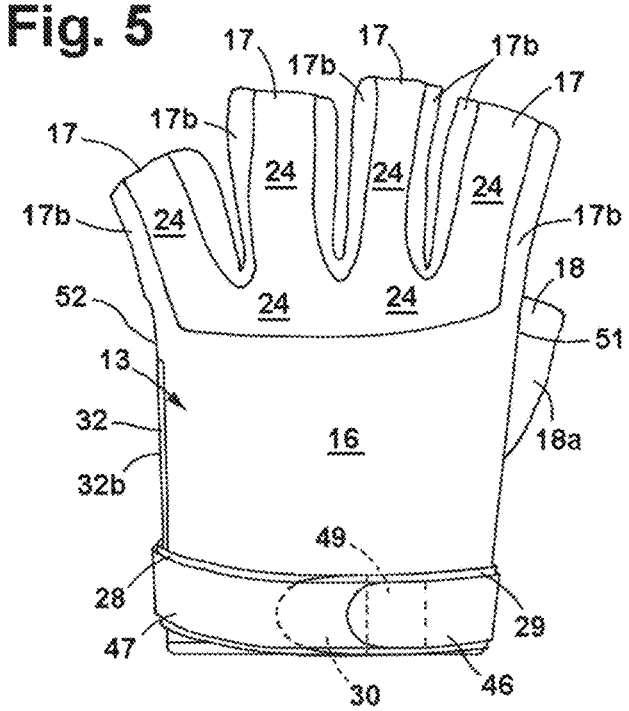
FIG. 5 is a rear elevational view of the embodiment of FIG. 4.

The embodiment illustrated in FIGS. 4-5 is generally similar to the embodiment of FIGS. 1-3, and like reference numerals designate corresponding elements in the two. In the embodiment of FIGS. 4-5, inner glove 11 is identical to the inner glove shown in FIGS. 2 and 3, with wrist straps 28, 29 securing the lower portion of the inner glove about the base of the hand and wrist.

In this embodiment, outer panel 12 once again has a substantially non-stretchable leather section 31 at the base of the palm and a stretchable section 32 of a material such as Lycra® fabric that overlies the rest of the palm. Here, however, the stretchable material extends all the way to the lower edge of the glove beneath the leather section, and the leather is attached to it by stitching 33-35. Straps 46, 47 wrap around the back side of the glove below the base of the thumb and are secured together over straps 28, 29 by a Velcro® fastener 49. Straps 46, 47 are attached to or formed integrally with the outer panel and are not attached to the inner glove.

Outer panel 12 is attached to the inner body of the glove by stitching 34 along the lower edge portion of leather section 31 and by stitching 36 along the upper edge portion of stretchable section 32 just below the bases of the finger stalls. The upper portion of the stretchable section is also attached to the thumb and ring finger sides of the inner glove above the thumb stall and the transverse creases of the hand in the areas designated by reference numerals 51 and 52. Otherwise the lateral edges 31*a*, 31*b* of leather section 31 and the lateral edges 32*a*, 32*b* of stretchable section 32 are detached from the body of the glove.

With the outer panel being detached in this manner, it is free to move relative to the palm section of the inner glove, with minimal friction between the inner and outer palm layers as well as on the surface of the skin on the palm. The outer panel is anchored about the wrist by securing straps 46 & 47 in the wrist area located at the base of the hand below the palm and thumb, pre-tensioning the palm section to expand and contract as the hand is curled and uncurled, gently drawing the hand toward the curled position to facilitate gripping of the object.

In the embodiment of FIGS. 6-8, the inner glove differs from the inner gloves of the previous embodiments in that the stretchable upper section 21 on the palm side terminates part way up the finger stalls rather than extending to the tips of the stalls. It is attached to the upper edge portion of the non-stretchable lower section 19 by stitching 22, and it is also attached to the lower portions of the side panels or fourchettes 17*b* of the finger stalls.

The back side of the inner glove in this embodiment consists primarily of a continuous piece of spandex 16 which extends from to lower edge of the glove to the tips of the finger stalls, with leather reinforcing strips 54 extending diagonally across the back of the hand and up the back walls 17*c* of the finger stalls. The back section 18*a* of the thumb stall is also spandex, and the front section 18*b* is the same substantially non-stretchable leather material as the lower section 19 of the palm side.

In this embodiment, outer panel 12 has a lower section 31 of substantially non-stretchable material such as leather, a middle section 57 of stretchable material such as Lycra® fabric, and an upper section 58 of substantially non-stretchable material. As in the embodiment of FIGS. 4-5, the stretchable material extends all the way to the lower edge of the glove beneath the leather section, and the leather is attached to it by stitching 33-35, with straps 46, 47 being attached to the leather and/or the stretchable material and wrapping around the back side of the glove.

The side edges 57*a*, 57*b* of stretchable material 57 extend freely around the base of thumb stall 18 and for a short distance above the leather section on the little finger side of the glove. The edge portion of the stretchable material that extends around the base of the thumb is wide enough that it rides up higher on the thumb as the thumb is curled, thereby preventing the edge portion from rolling over or under and interfering with the movement of the thumb. The upper section of substantially non-stretchable material 58 extends from the upper edge portion of the stretchable material to the tips of the finger stalls and forms the front walls 17*a* of the stalls. It also overlies the upper part of the palm and extends down into the lower section of the palm where it is spaced from the upper edge 31*a* of lower section 31 and side edge 57*a* of the stretchable section by a distance on the order of one-half inch. The upper section is attached to side panels 17*b* of the finger stalls and to the thumb and little finger sides of body 13 down to about the transverse fold lines of the palm.

A pad 59 of grip enhancing and/or protective material such as leather is attached and overlies the palm portion of the upper section 58 of outer panel 12. This pad is attached to the palm portion by peripheral stitching 61 and by interior stitching 62 which generally follows the fold lines of the palm.

As in the other embodiments, the outer panel is free to move relative to the palm section of the inner glove, with minimal friction on the surface of the skin on the palm as well as minimal friction between the two palm layers of the glove. Here also, the outer panel, anchored at the wrist, pre-tensions the palm section and expands and contracts as the hand is curled and uncurled, gently drawing the hand toward the curled position to facilitate gripping of the object.

Figure 9:
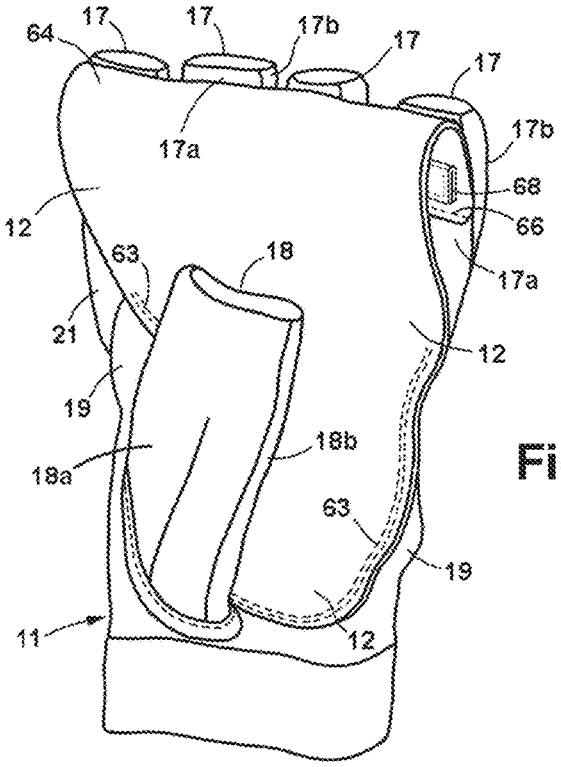
FIG. 9 is a front isometric view of another embodiment of a glove incorporating the invention.
Figure 10:
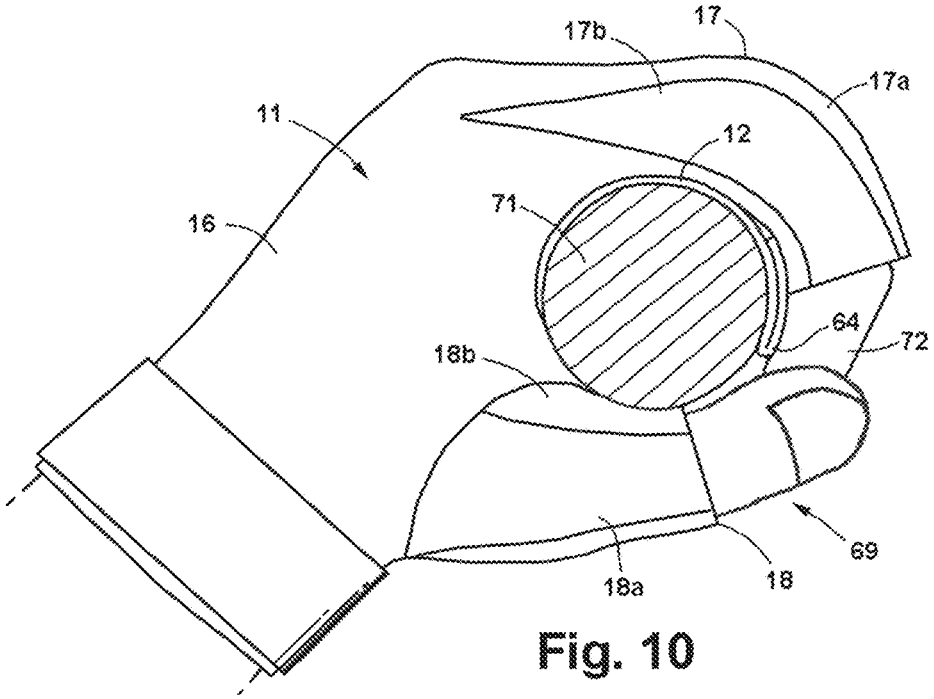
FIG. 10 is a side elevational view of the embodiment of FIG. 9 with the glove on a hand which is gripping an object.

In the embodiment of FIGS. 9-10, inner glove 11 has a lower palm section 19 of relatively non-stretchable material such as leather which extends from the base to the upper part of the palm and an upper palm section 21 of highly flexible material such as spandex which extends from the upper part of the palm to the tips of finger stalls 17 and forms the front walls 17*a* of the stalls. This structure is similar to that shown in FIG. 2.

In this embodiment, outer panel 12 consists entirely of a substantially non-stretchable material such as leather which is attached to lower palm section 19 by stitching 63 along the side and lower edge portions of the panel. The panel begins near the base of the thumb and extends up the palm on the inner side of thumb stall 18 without being attached directly to the thumb stall although it is attached to palm section 19 along the inner side of the thumb stall by stitching 63.

The upper or distal portion 64 of panel 12 is rolled over toward the back of the hand and attached to the front sides 17*a* of the finger stalls by stitching 66, with the rolled edge roughly even with the tips of the finger stalls. Pads 68 are attached to the inner side of the outer panel on the front sides of the finger stalls. These pads are preferably filled with a non-hardening, moldable material as discussed in greater detail in application Ser. No. 12/842,362. Alternatively, they can be filled with a resilient foam, or they can be omitted entirely, if desired.

FIG. 10 shows the glove on a hand 69 in gripping engagement with an object 71 such as the bar of a barbell or dumbbell. As the hand grips the object, outer panel 12 is free to move relative to the palm section of the inner glove and to itself, with minimal friction on the surface of the skin on the palm or fingers. As the grip is tightened, the rolled portion 64 of the outer panel is flattened out and extends farther up the fingers 72 toward the tips to protect that portion of the fingers and improve the grip between the fingers and the object.

The invention has a number of important features and advantages. It protects the hand of a wearer and provides a better grip with no bunching up or gathering of material between the palm and the object. With the outer panel free to move relative to the palm section of the inner glove, there is no friction on the surface of the skin of the palm when the hand wraps about and grips an object, as there would be without the glove or with other gloves. When the outer panel includes a stretchable or elastic material, it pre-tensions the palm section, maintains that tension, and makes the glove fit like skin. With the rolled panel, the glove provides additional protection for the upper portions of the fingers and provides enhanced gripping of the object.

It is apparent from the foregoing that a new and improved glove for use in weightlifting and other activities involving the gripping of an object has been provided. While only certain presently preferred embodiments have been described in detail, as will be apparent to those familiar with the art, certain changes and modifications can be made without departing from the scope of the invention as defined by the following claims.

The invention claimed is:

1. A glove for gripping an object, comprising an inner glove having a palm section adapted to overlie the palm of the hand, a back section adapted to overlie the back of the hand, and stalls for receiving the fingers and thumb, and an outer panel that overlies the entire palm section and is affixed to the palm section along an upper margin of the palm section below the finger stalls and along lower margins of the outer panel and palm section, with the outer panel being detached from the inner glove along at least one lateral edge of the outer panel.

2. The glove of claim 1 wherein the outer panel is attached to the upper margin of the palm section along an upper margin of the panel.

3. The glove of claim 1 wherein the outer panel extends from the lower edge of the palm section to the tips of the finger stalls and forms the front walls of the finger stalls.

4. The glove of claim 1 wherein a lower portion of the palm section is relatively non-stretchable, and an upper portion is relatively stretchable.

5. The glove of claim 4 wherein the lower portion of the palm section is leather, and the upper portion is an elastic material.

6. The glove of claim 4 wherein the lower portion of the palm section is adapted to extend between the base of the palm and the transverse fold lines of the palm when the glove is placed on the hand.

7. The glove of claim 4 wherein the relatively stretchable portion of the palm section extends to the tips of the finger stalls and forms front walls of the finger stalls.

8. The glove of claim 4 wherein the relatively stretchable portion of the palm section terminates part way up the finger stalls.

9. The glove of claim 1 wherein the outer panel is fabricated of an elastic material which extends between the base of the palm section and the tips of the finger stalls and draws a hand wearing the glove toward a closed position to facilitate gripping of an object.

10. The glove of claim 1 wherein the outer panel is fabricated of a substantially non-stretchable material and is attached at one end to the base portion of the palm section, with a distal end portion of the panel extending beyond the finger stalls and being rolled back and attached to the front sides of the stalls.

11. The glove of claim 1 wherein the outer panel is attached to the inner glove along the thumb side of the palm section except between the lower margin of the palm section and an area of the palm section that will overlie the transverse fold lines of the palm when the glove is placed on the hand.

12. The glove of claim 1 wherein the panel is attached to the inner glove along both the thumb side and the little finger side of the palm section except between the lower margin of the palm section and an area of the palm section that will overlie the transverse fold lines of the palm when the glove is placed on the hand.

13. The glove of claim 1 wherein the outer panel is attached to the inner glove along the little finger side of the glove.

14. The glove of claim 1 including grip enhancing pads on the outer panel for engagement with the object.

15. A glove for gripping an object, comprising an inner glove having a lower palm section of relatively non-stretchable material and an upper palm section of relatively stretchable material that are adapted to overlie the palm side of the hand of a person wearing the glove, a back section that is adapted to overlie the back of the hand, and stalls for receiving the fingers and thumb, and an outer panel of elastic material that overlies substantially the entire palm section and is attached to the inner glove along upper and lower margins of the outer panel for drawing the hand toward a closed position for gripping an object.

16. The glove of claim 15 wherein the outer panel extends from the lower edge of the lower palm section of the inner glove to the tips of the finger stalls and forms the front walls of the finger stalls.

17. The glove of claim 16 including grip enhancing pads on the portion of the outer panel that overlies the palm and on the portions that form the front walls of the finger stalls.

18. The glove of claim 15 wherein the upper palm section of the inner glove extends to tips of the finger stalls, and the outer panel terminates below the finger stalls.

19. The glove of claim 18 including grip enhancing pads on the outer panel and the finger stalls for engagement with the object.

20. The glove of claim 15 wherein the outer panel is attached to the inner glove along the thumb side except between the lower edge of the lower palm section of the inner glove and an area of the palm section that will overlie the transverse fold lines of the palm when the glove is placed on the hand.

21. The glove of claim 20 wherein the outer panel is attached to the inner glove along the little finger side of the glove.

22. A glove for gripping an object, comprising an inner glove having a palm section adapted to overlie the palm of the hand, a back section adapted to overlie the back of the hand, and stalls for receiving the fingers and thumb; and an outer panel that overlies the palm section, with an upper portion of the outer panel being attached to the inner glove and a lower portion of the outer panel being anchored in such manner that the outer panel draws the hand toward a closed position for gripping an object.

23. The glove of claim 22 wherein the outer panel is attached to the inner glove along upper and lower margins of the outer panel and the palm section.

24. The glove of claim 22 including a strap extending laterally from the lower portion of the outer panel for anchoring the lower portion of the outer panel to the base of the hand and wrist.

25. The glove of claim 24 wherein the strap is not attached to the inner glove.

26. A glove for gripping an object, comprising a palm section adapted to overlie the palm of the hand, a back section adapted to overlie the back of the hand, stalls for receiving the fingers, an outer panel that overlies the entire palm section, with an upper portion of the outer panel being attached to the palm section below the finger stalls, and a pair of wrist straps extending laterally from the lower side margins of the outer panel for securing the lower portion of the outer panel to the base of the hand.

* * * * *